US011512687B2

(12) United States Patent
Takahashi

(10) Patent No.: US 11,512,687 B2
(45) Date of Patent: Nov. 29, 2022

(54) CRYOPUMP

(71) Applicant: SUMITOMO HEAVY INDUSTRIES, LTD., Tokyo (JP)

(72) Inventor: Kakeru Takahashi, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 475 days.

(21) Appl. No.: 16/533,117

(22) Filed: Aug. 6, 2019

(65) Prior Publication Data

US 2019/0360478 A1 Nov. 28, 2019

Related U.S. Application Data

(63) Continuation of application No. PCT/JP2018/003573, filed on Feb. 2, 2018.

(30) Foreign Application Priority Data

Feb. 7, 2017 (JP) ..... JP2017-020092

(51) Int. Cl.
*F04B 37/08* (2006.01)
*F04B 37/02* (2006.01)
*F04B 39/06* (2006.01)

(52) U.S. Cl.
CPC ..... *F04B 37/08* (2013.01); *F04B 37/02* (2013.01); *F04B 39/06* (2013.01)

(58) Field of Classification Search
CPC ..... B01D 8/00; F04B 37/08
See application file for complete search history.

(56) References Cited

U.S. PATENT DOCUMENTS 4,718,241 A * 1/1988 Lessard ..... F04B 37/08 417/901
5,001,903 A * 3/1991 Lessard ..... F04B 37/08 417/901
5,211,022 A * 5/1993 Bartlett ..... F04B 37/08 417/901
7,313,922 B2 1/2008 Bartlett et al.
2006/0064990 A1 3/2006 Bartlett et al.
(Continued)

FOREIGN PATENT DOCUMENTS

JP H06-033874 A 2/1994
JP H10-213065 A 8/1998
(Continued)

*Primary Examiner* — Lionel Nouketcha
(74) *Attorney, Agent, or Firm* — Michael Best & Friedrich LLP

(57) ABSTRACT

A cryopump includes a cryocooler which includes a high-temperature cooling stage and a low-temperature cooling stage, a radiation shield which is thermally coupled to the high-temperature cooling stage and axially extends in a tubular shape from a cryopump intake port, a low-temperature cryopanel section which is thermally coupled to the low-temperature cooling stage, is surrounded by the radiation shield, and includes axially arranged cryopanels including a top cryopanel disposed closest to the cryopump intake port, and a top cryopanel accommodation cryopanel which is thermally coupled to the high-temperature cooling stage and is disposed in the cryopump intake port to form a top cryopanel accommodation compartment.

18 Claims, 3 Drawing Sheets

(56) References Cited

U.S. PATENT DOCUMENTS

| | | | | |
|---|---|---|---|---|
| 2009/0038319 | A1* | 2/2009 | Tsuyuki | F04B 37/08 62/55.5 |
| 2014/0345300 | A1* | 11/2014 | Takahashi | F04B 37/08 62/55.5 |
| 2017/0009756 | A1* | 1/2017 | Wells | F04B 53/16 |

FOREIGN PATENT DOCUMENTS

| | | | |
|---|---|---|---|
| JP | 2008-514849 | A | 5/2008 |
| JP | 2012-047120 | A | 3/2012 |
| JP | 2012-180846 | A | 9/2012 |
| JP | 2012-237262 | A | 12/2012 |
| JP | 2014-227989 | A | 12/2014 |

* cited by examiner

CRYOPUMP

RELATED APPLICATIONS

The contents of Japanese Patent Application No. 2017-020092, and of International Patent Application No. PCT/JP2018/003573, on the basis of each of which priority benefits are claimed in an accompanying application data sheet, are in their entirety incorporated herein by reference.

BACKGROUND

Technical Field

Certain embodiment of the present invention relates to a cryopump.

Description of Related Art

A cryopump is a vacuum pump which condenses and adsorbs gas molecules on a cryopanel cooled to a cryogenic temperature to capture and exhaust the gas molecules. In general, the cryopump is used to realize a clean vacuum environment which is required in a semiconductor circuit manufacturing process or the like. For example, in one of applications of the cryopump like an ion implantation process, most of gases to be exhausted may be a non-condensable gas such as hydrogen. The non-condensable gas can be exhausted by being adsorbed to an adsorption region cooled to a cryogenic temperature.

SUMMARY

According to an embodiment of the present invention, there is provided a cryopump including: a cryocooler which includes a high-temperature cooling stage and a low-temperature cooling stage; a radiation shield which is thermally coupled to the high-temperature cooling stage and axially extends in a tubular shape from a cryopump intake port; a low-temperature cryopanel section thermally coupled to the low-temperature cooling stage and surrounded by the radiation shield, the low-temperature cryopanel section including axially arranged cryopanels including a top cryopanel disposed closest to the cryopump intake port; and a top cryopanel accommodation cryopanel which is thermally coupled to the high-temperature cooling stage and is disposed in the cryopump intake port to forma top cryopanel accommodation compartment.

DETAILED DESCRIPTION

Figure 1:
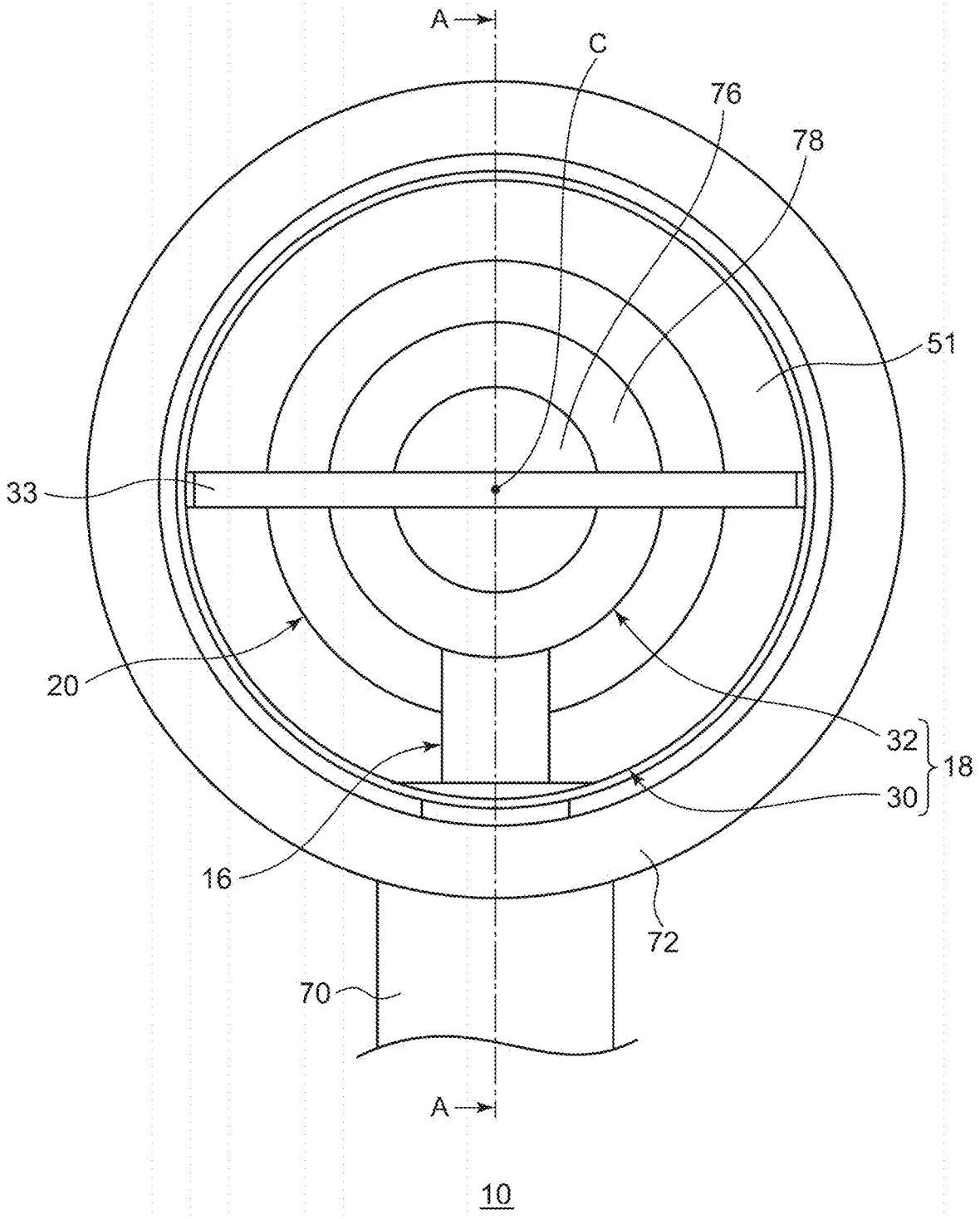
FIG. 1 is a top view schematically showing a cryopump according to an embodiment.

In general, a high-temperature cryopanel which is cooled to a first cooling temperature is disposed in an intake port of a cryopump. One role of the high-temperature cryopanel is to suppress heat input to a low-temperature cryopanel which is cooled to a second cooling temperature lower than the first cooling temperature. A relatively small high-temperature cryopanel is adopted in a cryopump which is mainly used to exhaust a non-condensable gas. In this case, an intake port area covered by the high-temperature cryopanel is relatively small, and thus, a flow rate of the non-condensable gas entering the low-temperature cryopanel through the intake port increases, and it is possible to increase an pumping speed of the non-condensable gas. Meanwhile, miniaturization of the high-temperature cryopanel can increase heat input to low-temperature cryopanel. Typically, a louver is used for the high-temperature cryopanel. However, the heat input to the low-temperature cryopanel through a gap between wing plates cannot be ignored.

It is desirable to improve the pumping speed by the low-temperature cryopanel while decreasing a thermal load of the low-temperature cryopanel.

In addition, components or expressions of the present invention may be replaced by each other in methods, devices, systems, or the like, and these replacements are also included in aspects of the present invention.

According to the present invention, it is possible to improve the pumping speed by the low-temperature cryopanel while decreasing the thermal load of the low-temperature cryopanel.

Hereinafter, an embodiment of the present invention will be described in detail with reference to the drawings. In descriptions and drawings, the same or equivalent components, members, and processes are denoted by the same reference numerals, and repeated descriptions thereof will be appropriately omitted. Scales and shapes of shown parts are set conveniently for ease of explanation, and are not to be interpreted as being limited unless otherwise noted. The embodiment is illustrative and do not limit the scope of the present invention. All features or combinations thereof described in the embodiment are not necessarily essential to the invention.

Figure 2:
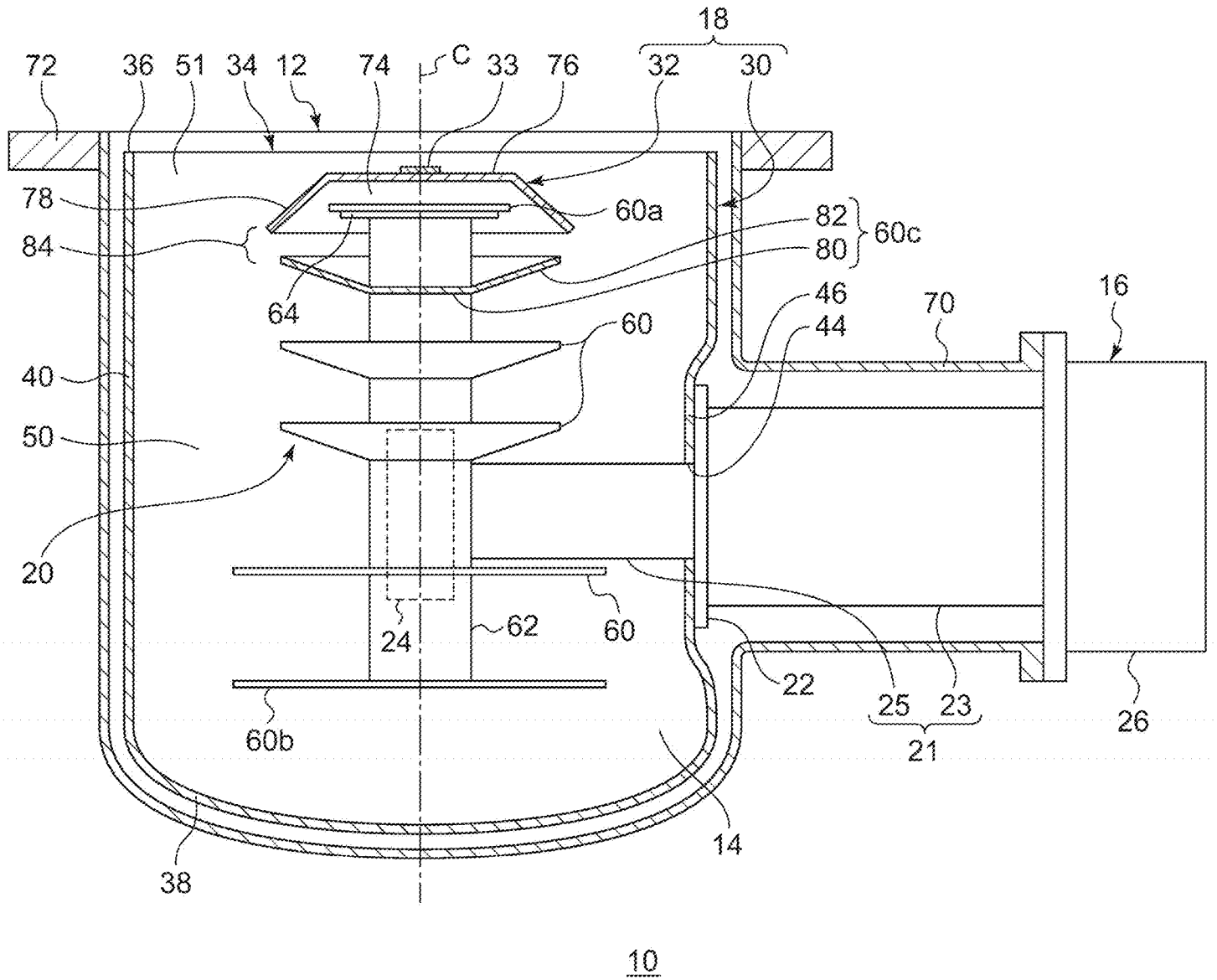
FIG. 2 schematically shows a cross section taken along line A-A of the cryopump shown in FIG. 1.
Figure 3:
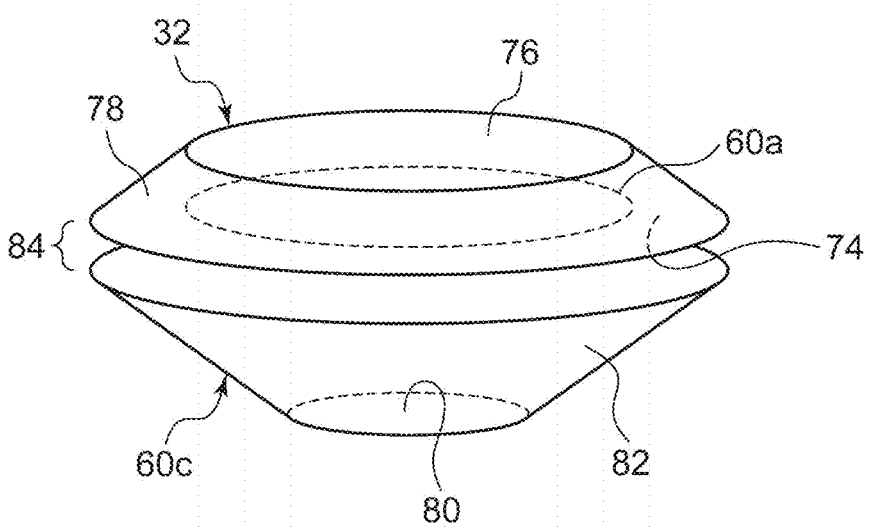
FIG. 3 is a schematic perspective view showing a portion of a cryopanel arrangement according to the embodiment.

FIG. 1 is a top view schematically showing a cryopump 10 according to an embodiment. FIG. 2 schematically shows a cross section taken along line A-A of the cryopump 10 shown in FIG. 1. FIG. 3 is a schematic perspective view showing a portion of a cryopanel arrangement according to the embodiment.

For example, the cryopump 10 is attached to a vacuum chamber of an ion implanter, a sputtering apparatus, vapor deposition apparatus, or other vacuum processing apparatus, and is used to increase a degree of vacuum inside the vacuum chamber to the level required for a desired vacuum process. The cryopump 10 has a cryopump intake port (hereinafter, simply referred to as an "intake port") 12 for receiving a gas to be exhausted from the vacuum chamber. The gas enters an internal space 14 of the cryopump 10 through the intake port 12.

In addition, hereinafter, terms such as an "axial direction" and a "radial direction" are used to easily indicate positional relationships of components of the cryopump 10. The axial direction of the cryopump 10 indicates a direction (a direction along a center axis C in the drawings) passing through the intake port 12, and the radial direction indicates a direction (a direction perpendicular to the center axis C) along the intake port 12. For convenience, a side relatively close to the intake port 12 in the axial direction may be referred to as an "upper side", and a side relatively far from the intake port 12 may be referred to as a "lower side". That is, a side relatively far from a bottom section of the cryopump 10 may be referred to as the "upper side", and a side relatively close to the bottom section may be referred to as the "lower side". A side close to a center (the center axis C in the drawings) of the intake port 12 in the radial direction may be referred to as an "inner side", and a side close to a peripheral edge of the intake port 12 may be referred to as an "outer side". In addition, the above-described expressions are not related to the disposition of the cryopump 10 when the cryopump 10 is attached to the vacuum chamber. For example, the cryopump 10 may be attached to the vacuum chamber in a state where the intake port 12 is positioned downward in a vertical direction.

In addition, a direction surrounding the axial direction may be referred to a "circumferential direction". The circumferential direction is a second direction along the intake port 12 and is a tangential direction orthogonal to the radial direction.

The cryopump 10 includes a cryocooler 16, a first stage cryopanel 18, a second stage cryopanel assembly 20, and a cryopump housing 70. The first stage cryopanel 18 may be referred to as a high-temperature cryopanel section or a 100K section. The second stage cryopanel assembly 20 may be referred to as a low-temperature cryopanel section or a 10K section.

For example, the cryocooler 16 is a cryocooler such as a Gifford McMahon type cryocooler (so-called GM cryocooler). The cryocooler 16 is a two-stage cryocooler. Accordingly, the cryocooler 16 includes a first cooling stage 22 and a second cooling stage 24. The cryocooler 16 is configured so as to cool the first cooling stage 22 to a first cooling temperature and cool the second cooling stage 24 to a second cooling temperature. The second cooling temperature is lower than the first cooling temperature. For example, the first cooling stage 22 is cooled to approximately 65K to 120K, preferably, 80K to 100K, and the second cooling stage 24 is cooled to approximately 10K to 20K.

In addition, the cryocooler 16 includes a cryocooler structural section 21 which structurally supports the second cooling stage 24 to the first cooling stage 22 and structurally supports the first cooling stage 22 to a room-temperature section 26 of the cryocooler 16. Accordingly, the cryocooler structural section 21 includes a first cylinder 23 and a second cylinder 25 which coaxially extend in the radial direction. The first cylinder 23 connects the room-temperature section 26 of the cryocooler 16 to the first cooling stage 22. The second cylinder 25 connects the first cooling stage 22 to the second cooling stage 24. The room-temperature section 26, the first cylinder 23, the first cooling stage 22, the second cylinder 25, and the second cooling stage 24 are linearly arranged in this order.

A first displacer (not shown) and a second displacer (not shown) are respectively disposed inside the first cylinder 23 and the second cylinder 25 so as to be reciprocated. A first regenerator and a second regenerator (not shown) are respectively incorporated into the first displacer and the second displacer. Moreover, the room-temperature section 26 includes a drive mechanism (not shown) for reciprocating the first displacer and the second displacer. The drive mechanism includes a flow path switching mechanism which switches a flow path of a working gas (for example, helium) such that the working gas is repeatedly supplied to or discharged from the inside of the cryocooler 16 periodically.

The cryocooler 16 is connected to a compressor (not shown) of the working gas. The cryocooler 16 expands the working gas compressed by the compressor inside the cryocooler 16 to cool the first cooling stage 22 and the second cooling stage 24. The expanded working gas is recovered to the compressor so as to be compressed again. The cryocooler 16 repeats a thermal cycle which includes supplying and discharging of the working gas and reciprocations of the first displacer and the second displacer synchronized with the supplying and the discharging, and generates chill.

The shown cryopump 10 is a so-called horizontal cryopump. In general, the horizontal cryopump is a cryopump in which the cryocooler 16 is disposed to intersect (generally, to be orthogonal to) the center axis C of the cryopump 10.

The first cryopanel unit 18 includes a radiation shield 30 and a top cryopanel accommodation cryopanel (hereinafter, referred to as an "inlet cryopanel") 32, and encloses the second stage cryopanel assembly 20. The first stage cryopanel 18 provides a cryogenic surface to protect the second stage cryopanel assembly 20 from radiant heat from the outside of the cryopump 10 or the cryopump housing 70. The first stage cryopanel 18 is thermally coupled to the first cooling stage 22. Accordingly, the first stage cryopanel 18 is cooled to the first cooling temperature. The first stage cryopanel 18 has a gap between the first stage cryopanel 18 and the second stage cryopanel assembly 20, and the first stage cryopanel 18 is not in contact with the second stage cryopanel assembly 20. The first stage cryopanel 18 is not in contact with the cryopump housing 70.

The radiation shield 30 is provided to protect the second stage cryopanel assembly 20 from the radiant heat of the cryopump housing 70. The radiation shield 30 extends in a tubular shape (for example, a cylindrical shape) in the axial direction from the intake port 12. The radiation shield 30 is positioned between the cryopump housing 70 and the second stage cryopanel assembly 20, and surrounds the second stage cryopanel assembly 20. The radiation shield 30 includes a shield main opening 34 for receiving a gas from the outside of the cryopump 10 to the internal space 14. The shield main opening 34 is positioned at the intake port 12.

The radiation shield 30 includes a shield front end 36 which defines the shield main opening 34, a shield bottom section 38 which is positioned on a side opposite to the shield main opening 34, and a shield side section 40 which connects the shield front end 36 to the shield bottom section 38. The shield side section 40 extends from the shield front end 36 to the side opposite to the shield main opening 34 in the axial direction, and extends to surround the second cooling stage 24 in the circumferential direction.

The shield side section 40 includes a shield side section opening 44 through which the cryocooler structural section 21 is inserted. The second cooling stage 24 and the second cylinder 25 are inserted from the outside of the radiation shield 30 into the radiation shield 30 through the shield side section opening 44. The shield side section opening 44 is an attachment hole which is formed on the shield side section 40, and, for example, has a circular shape. The first cooling stage 22 is disposed outside the radiation shield 30.

The shield side section 40 includes an attachment seat 46 of the cryocooler 16. The attachment seat 46 is a flat portion for attaching the first cooling stage 22 to the radiation shield 30, and is slightly recessed when viewed from the outside of the radiation shield 30. The attachment seat 46 forms the outer periphery of the shield side section opening 44. The first cooling stage 22 is attached to the attachment seat 46. Therefore, the radiation shield 30 is thermally coupled to the first cooling stage 22.

Instead of the radiation shield 30 being directly attached to the first cooling stage 22, in an embodiment, the radiation shield 30 may be thermally coupled to the first cooling stage 22 via an additional heat transfer member. For example, the heat transfer member may be a short hollow tube having flanges on both ends. The heat transfer member may be fixed to the attachment seat 46 by one end flange, and may be fixed to the first cooling stage 22 by the other end flange. The heat transfer member may surround the cryocooler structural section 21 and may extend from the first cooling stage 22 to the radiation shield 30. The shield side section 40 may include the heat transfer member.

In the shown embodiment, the radiation shield 30 has an integral tubular shape. Instead of this, the radiation shield 30 may have the entire tubular shape including a plurality of parts. The plurality of parts may be disposed to have gaps to each other. For example, the radiation shield 30 may be divided into two portions in the axial direction. In this case, the upper portion of the radiation shield 30 is a tube having both open ends, and includes the shield front end 36 and a first section of the shield side section 40. The lower portion of the radiation shield 30 also is a tube having both open ends, and includes a second section of the shield side section 40 and the shield bottom section 38. A slit is formed, which extends in the circumferential direction between the first section and the second section of the shield side section 40. The slit may form at least a portion of the shield side section opening 44. Alternatively, the upper half of the shield side section opening 44 may be formed on the first section of the shield side section 40, and the lower half thereof may be formed on the second section of the shield side section 40.

The radiation shield 30 forms a gas accommodation space 50 which surrounds the second stage cryopanel assembly 20 between the intake port 12 and the shield bottom section 38. The gas accommodation space 50 is a portion of the internal space 14 of the cryopump 10, and is a region adjacent to the second stage cryopanel assembly 20 in the radial direction.

The inlet cryopanel 32 is provided in the intake port 12 (or, the shield main opening 34, and so on) to protect the second stage cryopanel assembly 20 from radiant heat from an external heat source (for example, a heat source in the vacuum chamber to which the cryopump 10 is attached) of the cryopump 10. In addition, a gas (for example, water) condensed at the cooling temperature of the inlet cryopanel 32 is captured on the surface.

The inlet cryopanel 32 is disposed at a location corresponding to the second stage cryopanel assembly 20 in the intake port 12. The inlet cryopanel 32 occupies the center portion of an opening area of the intake port 12 and forms an annular opening region 51 between the inlet cryopanel 32 and the radiation shield 30. The inlet cryopanel 32 may occupy at most ⅓, or at most ¼ of the opening area of the intake port 12. Accordingly, the opening region 51 may occupy at least ⅔, or at least ¾ of the opening area of the intake port 12. The opening region 51 is positioned at a location corresponding to the gas accommodation space 50 in the intake port 12. The opening region 51 is an inlet of the gas accommodation space 50, and the cryopump 10 receives gas into the gas accommodation space 50 through the opening region 51.

The inlet cryopanel 32 is attached to the shield front end 36 via an inlet cryopanel attachment member 33. The inlet cryopanel attachment member 33 is a rod-shaped member bridged to the shield front end 36 along a diameter of the shield main opening 34. Thus, the inlet cryopanel 32 is fixed to the radiation shield 30 and is thermally coupled to the radiation shield 30. The inlet cryopanel 32 is close to but not in contact with the second stage cryopanel assembly 20.

The second stage cryopanel assembly 20 is provided at a center portion of the internal space 14 of the cryopump 10. The second stage cryopanel assembly 20 includes a plurality of cryopanels 60 which are arranged in the axial direction and a second stage panel attachment member 62. The second stage panel attachment member 62 extends axially upward or downward from the second cooling stage 24. The second stage cryopanel assembly 20 is attached to the second cooling stage 24 via the second stage panel attachment member 62. In this way, the second stage cryopanel assembly 20 is thermally coupled to the second cooling stage 24. Therefore, the second stage cryopanel assembly 20 is cooled to the second cooling temperature.

The plurality of cryopanels 60 are arranged on the second stage panel attachment member 62 along a direction (that is, along the center axis C) from the shield main opening 34 to the shield bottom section 38. The plurality of cryopanels 60 are arranged at intervals in the axial direction.

For convenience of explanation, in the plurality of cryopanels 60, a cryopanel closest to the intake port 12 in the axial direction may be referred to as a top cryopanel **60*a*, and in the plurality of cryopanels 60, a cryopanel closest to the shield bottom section 38 maybe referred to as a bottom cryopanel 60*b*. In addition, a cryopanel 60 second closet to the intake port 12, that is, a cryopanel 60 disposed to be axially adjacent to the top cryopanel 60*a* may be referred to as an adjacent cryopanel 60*c*. The adjacent cryopanel 60*c* is disposed immediately below the top cryopanel 60*a* in the axial direction. The top cryopanel 60*a* is interposed between the inlet cryopanel 32 and the adjacent cryopanel 60*c***.

The top cryopanel **60*a* is a flat plate and is disposed perpendicularly to the axial direction. For example, when the top cryopanel 60*a* is viewed in the axial direction, a shape of the top cryopanel 60*a* is a disk shape. A center of the top cryopanel 60*a* is positioned on the center axis C of the cryopump 10, and an outer periphery of the top cryopanel 60*a* has a circular shape. In the plurality of cryopanels 60, the top cryopanel 60*a*** has a smallest diameter.

The adjacent cryopanel **60*c* has an inverted truncated cone shape and is disposed to be circular when viewed in the axial direction. A center of adjacent cryopanel 60*c* is positioned on center axis C. The adjacent cryopanel 60*c* has a diameter larger than that of the top cryopanel 60*a*. In addition, similarly to the top cryopanel 60*a*, the adjacent cryopanel 60*c*** has a flat plate and may have a disk shape, for example.

As show in FIG. 2, at least one cryopanel 60 which is disposed to be adjacent axially below the adjacent cryopanel **60*c* may have the same shape as that of the adjacent cryopanel 60*c***.

Similarly to the top cryopanel **60*a*, the bottom cryopanel 60*b* is a flat plate and may have a disk shape, for example. Alternatively, similarly to the adjacent cryopanel 60*c*, the bottom cryopanel 60*b* has an inverted truncated cone shape. A center of the bottom cryopanel 60*b* and centers of other cryopanels 60 are also positioned on the center axis C. The bottom cryopanel 60*b* has a diameter larger than that of the top cryopanel 60*a*. The bottom cryopanel 60*b* may have a diameter larger than that of the adjacent cryopanel 60*c*. At least one cryopanel 60 which is disposed to be adjacent to the bottom cryopanel 60*b* axially above the bottom cryopanel 60*b* may have the same shape as that of the bottom cryopanel 60*b***.

The top cryopanel **60*a* and the adjacent cryopanel 60*c* are disposed between the inlet cryopanel 32 and the second cooling stage 24 in the axial direction. The bottom cryopanel 60*b* is disposed between the second cooling stage 24 and the shield bottom section 38** in the axial direction.

An adsorption region 64 is formed on a surface of at least a portion of the second stage cryopanel assembly 20. The adsorption region 64 is provided to capture a non-condensable gas (for example, hydrogen) by adsorbing. For example, the adsorption region 64 is formed by adhering an adsorption material (for example, activated carbon) to a cryopanel surface. The adsorption region 64 may be formed at a shadowed position of the cryopanel 60 adjacent above so as not to be seen from the intake port 12. For example, the adsorption region 64 is formed on the entire region of a lower surface (rear surface) of the top cryopanel 60*a*. The adsorption region 64 is not provided on an upper surface (front surface) of the top cryopanel 60*a*. The adsorption region 64 may be formed on an upper center portion and/or an entire lower surface of each of other cryopanels 60 such as the bottom cryopanel 60*b* or the adjacent cryopanel 60*c*.

In addition, a condensation region for capturing a condensable gas by condensation is formed on a surface of at least a portion of the second stage cryopanel assembly 20. For example, the condensation region is a missing region of the adsorption material on the cryopanel surface, and a cryopanel substrate surface, for example, a metal surface is exposed to the condensation region. An upper surface outer peripheral section of the bottom cryopanel 60*b* may be the condensation region.

The cryopump housing 70 is a case of the cryopump 10 which accommodates the first stage cryopanel 18, the second stage cryopanel assembly 20, and the cryocooler 16, and is a vacuum vessel which is configured so as to hold vacuum sealing of the internal space 14. The cryopump housing 70 includes the first stage cryopanel 18 and the cryocooler structural section 21 in a non-contact manner. The cryopump housing 70 is attached to the room-temperature section 26 of the cryocooler 16.

The intake port 12 is defined by a front end of the cryopump housing 70. The cryopump housing 70 includes an intake port flange 72 which extends radially outward from the front end. The intake port flange 72 is provided over the entire periphery of the cryopump housing 70. The cryopump 10 is attached to the vacuum chamber of an evacuation object using the intake port flange 72.

Hereinafter, an operation of the cryopump 10 having the above-described configuration will be described. When the cryopump 10 is operated, first, a pressure inside the vacuum chamber is roughly set to approximately 1 Pa by other appropriate roughing pumps before the cryopump 10 is operated. Thereafter, the cryopump 10 is operated. The first cooling stage 22 and the second cooling stage 24 are respectively cooled to the first cooling temperature and the second cooling temperature by driving of the cryocooler 16. Accordingly, the first stage cryopanel 18 and the second stage cryopanel assembly 20, which are thermally coupled to the first cooling stage 22 and the second cooling stage 24, are respectively cooled to the first cooling temperature and the second cooling temperature.

The inlet cryopanel 32 cools gas flying from the vacuum chamber toward cryopump 10. Gas is condensed so as to have a sufficiently low vapor pressure (for example, $10^{-8}$ Pa or less) at the first cooling temperature on the surface of the inlet cryopanel 32. This gas may be referred to as a first kind of gas. For example, the first kind of gas is water vapor. In this way, the inlet cryopanel 32 through which the first kind of gas can be exhausted. A portion of gas having a vapor pressure which is not sufficiently low at the first cooling temperature can enter the internal space 14 from the intake port 12. Alternatively, the other portion of the gas is reflected by the inlet cryopanel 32, and does not enter the internal space 14.

The gas entering internal space 14 is cooled by the second stage cryopanel assembly 20. Gas having a sufficiently low vapor pressure (for example, $10^{-8}$ Pa or less) at the second cooling temperature is condensed on the surface of the second stage cryopanel assembly 20. This gas may be referred to as a second kind of gas. For example, the second kind of gas is argon. In this way, the second stage cryopanel assembly 20 can exhaust the second kind of gas.

Gas having a vapor pressure which is not sufficiently low at the second cooling temperature is adsorbed to the adsorption material of the second stage cryopanel assembly 20. This gas may be referred to as a third kind of gas. For example, the third kind of gas is hydrogen. In this way, the second stage cryopanel assembly 20 can exhaust the third kind of gas. Accordingly, the cryopump 10 exhausts various gas by condensation and adsorption, and a vacuum degree of the vacuum chamber can reach a desired level.

Next, the inlet cryopanel 32 according to the embodiment and a peripheral structure thereof will be described in more detail. For ease of understanding, in FIG. 2, cross sections of the inlet cryopanel 32 and the adjacent cryopanel 60*c* are schematically shown. FIG. 3 schematically shows a positional relationship between the inlet cryopanel 32, the top cryopanel 60*a*, and the adjacent cryopanel 60*c*.

The inlet cryopanel 32 forms a top cryopanel accommodation compartment 74. The top cryopanel accommodation compartment 74 is formed axially below the inlet cryopanel 32. The top cryopanel 60*a* is accommodated in the top cryopanel accommodation compartment 74. Accordingly, the top cryopanel 60*a* is covered by the inlet cryopanel 32.

The inlet cryopanel 32 is disposed close to the top cryopanel 60*a* so as to completely block a direct incidence of a gas molecule from the outside of the cryopump 10 onto the top cryopanel 60*a*. Here, the direct incidence of the gas molecule onto the top cryopanel 60*a* means that the gas molecule is incident on the top cryopanel 60*a* from the outside of the cryopump 10 through the intake port 12 without being reflected even once by cryopanels (that is, the radiation shield 30, the inlet cryopanel 32, and the cryopanel 60) other than the top cryopanel 60*a*. In other words, the inlet cryopanel 32 is arranged such that only a gas molecule reflected at least once by cryopanels other than top cryopanel 60*a* is incident on top cryopanel 60*a*. Since radiant heat coming from the outside of the cryopump 10 also has a linear path similar to that of the gas molecule, the inlet cryopanel 32 can also completely block the direct incidence of the radiant heat from the outside of the cryopump 10 onto the top cryopanel 60*a*. In order to block the gas molecule and radiant heat, preferably, the inlet cryopanel 32 does not have an opening such as a slit or a hole.

In the plurality of cryopanels 60 of the second stage cryopanel assembly 20, only the top cryopanel 60*a* is accommodated in the top cryopanel accommodation compartment 74. The entire top cryopanel 60*a* is accommodated in the top cryopanel accommodation compartment 74. The adjacent cryopanel 60*c* and other cryopanels 60 are not accommodated in the top cryopanel accommodation compartment 74.

A center of the inlet cryopanel 32 is positioned on the center axis C. The inlet cryopanel 32 has a diameter larger than that of the top cryopanel 60*a* and smaller than that of the bottom cryopanel 60*b*. For example, the diameter of the inlet cryopanel 32 may be approximately the same as the diameter of the adjacent cryopanel 60*c* or may be 90% to 110% of the diameter of the inlet cryopanel 32.

The inlet cryopanel 32 includes a central flat plate 76 and a downward inclined section 78. The central flat plate 76 faces an upper surface of the top cryopanel 60*a*. The central flat plate 76 is disposed in parallel to the top cryopanel 60*a*. The central flat plate 76 is disposed perpendicularly to the axial direction and extends in the radial direction. For example, the shape of the central flat plate 76 when viewed in the axial direction is a disk shape. A center of central flat plate 76 is positioned on the center axis C of the cryopump 10, and an outer periphery thereof is circular. For example, a diameter of the central flat plate 76 may be approximately the same as the diameter of the top cryopanel 60*a* or may be 90% to 110% of the diameter of the inlet cryopanel 32. A distance from the central flat plate 76 of the inlet cryopanel 32 to the top cryopanel 60*a* is smaller than an axial height (that is, the axial distance from the central flat plate 76 to an outermost periphery of the downward inclined section 78) of the inlet cryopanel 32. The inlet cryopanel attachment member 33 is fixed to an upper surface of the central flat plate 76.

In addition, the downward inclined section 78 of the inlet cryopanel 32 extends from the outer periphery of the central flat plate 76 to be inclined axially downward and radially outward with respect to the central flat plate 76. The downward inclined section 78 is provided on the entire periphery of the central flat plate 76. The outer periphery of the downward inclined section 78 is concentric with the central flat plate 76. In this way, the downward inclined section 78 surrounds an entire outer periphery of the top cryopanel 60*a*. For example, the downward inclined section 78 may be inclined at 30° to 60° with respect to the central flat plate 76 or may be inclined at approximately 45° with respect to the central flat plate 76. The downward inclined section 78 can also be referred to as a skirt section. In this way, the inlet cryopanel 32 has a truncated cone shape.

The top cryopanel accommodation compartment 74 is a truncated cone-shaped space which is defined by the central flat plate 76 and the downward inclined section 78 of the inlet cryopanel 32. The central flat plate 76 corresponds to a ceiling of the top cryopanel accommodation compartment 74, and the downward inclined section 78 corresponds to a side wall of the top cryopanel accommodation compartment 74.

The adjacent cryopanel 60*c* includes a cryopanel center section 80 and an upward inclined section 82. The cryopanel center section 80 faces the lower surface of the top cryopanel 60*a*. That is, the cryopanel center section 80 faces the adsorption region 64 on the top cryopanel 60*a*. The cryopanel center section 80 is a flat plate and is disposed in parallel to the top cryopanel 60*a*. The cryopanel center section 80 is disposed perpendicularly to the axial direction and extends in the radial direction. For example, the shape of the cryopanel center section 80 when viewed in the axial direction is a disk shape. A center of the cryopanel center section 80 is positioned on the center axis C of the cryopump 10, and an outer periphery thereof is circular. A diameter of the cryopanel center section 80 may be different from or the same as the diameter of the central flat plate 76. In the shown example, the cryopanel center section 80 has a diameter smaller than that of the central flat plate 76.

Moreover, the upward inclined section 82 of the adjacent cryopanel 60*c* extends from the outer periphery of the cryopanel center section 80 to be inclined axially upward and radially outward with respect to the cryopanel center section 80. The upward inclined section 82 is provided on the entire periphery of the cryopanel center section 80. The outer periphery of the upward inclined section 82 is concentric with the cryopanel center section 80. In this way, the upward inclined section 82 surrounds the entire outer periphery of the top cryopanel 60*a*. For example, the upward inclined section 82 may be inclined at 30° to 60° with respect to the cryopanel center section 80. An inclination angle of the upward inclined section 82 may be different from or the same as an inclination angle of the downward inclined section 78. In the shown example, the inclination angle of the upward inclined section 82 is smaller than the inclination angle of the downward inclined section 78. In this way, the adjacent cryopanel 60*c* has an inverted truncated cone shape.

The upward inclined section 82 of the adjacent cryopanel 60*c* extends in the circumferential direction along the downward inclined section 78 of the inlet cryopanel 32. In this way, a ring-shaped inlet 84 to the top cryopanel accommodation compartment 74 is formed between the upward inclined section 82 and the downward inclined section 78.

As described above, the adjacent cryopanel 60*c* is a portion of the second stage cryopanel assembly 20, and the inlet cryopanel 32 is a portion of the first stage cryopanel 18. Since both are cooled to different temperatures, the upward inclined section 82 of the adjacent cryopanel 60*c* is disposed in non-contact with the downward inclined section 78 of the inlet cryopanel 32. In this way, the ring-shaped inlet 84 is formed over the entire circumference in the circumferential direction. Moreover, an axial height (that is, an axial distance between the outer periphery of the downward inclined section 78 and the outer periphery of the upward inclined section 82) of the ring-shaped inlet 84 is smaller than an axial distance between the top cryopanel 60*a* and the adjacent cryopanel 60*c*.

The ring-shaped inlet 84 is only a gas passage leading to the top cryopanel accommodation compartment 74. A gas molecule which has entered the gas accommodation space 50 from the outside of the cryopump 10 through the opening region 51 cannot enter the top cryopanel accommodation compartment 74 only through the ring-shaped inlet 84. For example, the gas molecule may be reflected by the radiation shield 30 in gas accommodation space 50 and may enter the top cryopanel accommodation compartment 74 through the ring-shaped inlet 84.

Figure 4:
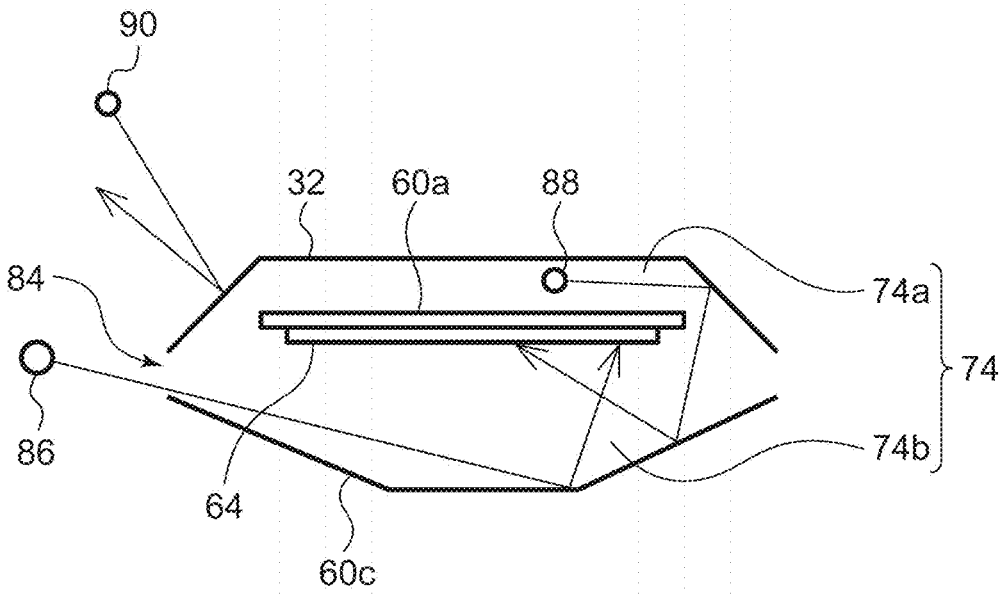
FIG. 4 is a schematic view for explaining behaviors of gas molecules in a portion of the cryopanel arrangement shown in FIG. 3.

FIG. 4 is a schematic view for explaining behaviors of gas molecules in a portion of the cryopanel arrangement shown in FIG. 3. In a case of non-condensable gas, a gas molecule 86 which has entered a region (that is, a lower half 74*b* of the top cryopanel accommodation compartment 74) between the top cryopanel 60*a* and the adjacent cryopanel 60*c* is reflected by the upper surface of the adjacent cryopanel 60*c*, and can be incident on the lower surface of the top cryopanel 60*a*. Accordingly, the gas molecule 86 is adsorbed to the adsorption region 64.

Meanwhile, a gas molecule 88 which has entered an area (that is, an upper half 74*a* of the top cryopanel accommodation compartment 74) between the top cryopanel 60*a* and the inlet cryopanel 32 is reflected once or multiple times by the lower surface of the inlet cryopanel 32 or the upper surface of the top cryopanel 60*a*, and may be incident on the lower half 74*b* of the top cryopanel accommodation compartment 74 again. Some gas molecules can be re-emitted from the ring-shaped inlet 84. However, the ring-shaped inlet 84 is narrow, and thus, there are less gas molecules which escape from the top cryopanel accommodation compartment 74 as such. In this way, most of the gas molecules entering the top cryopanel accommodation compartment 74 are adsorbed to the adsorption region 64.

The gas molecule 90 going from above to the inlet cryopanel 32 are blocked by the inlet cryopanel 32 and do not reach the top cryopanel 60*a*.

Assuming that there is no inlet cryopanel 32, most of thermal loads such as the gas molecule and the radiant heat coming from the outside of the cryopump 10 act on top cryopanel 60*a*, which is positioned on the top of the second stage cryopanel assembly 20. However, according to the cryopump 10 of the embodiment, the inlet cryopanel 32 forms the top cryopanel accommodation compartment 74. In this way, the top cryopanel 60*a* is accommodated in the top cryopanel accommodation compartment 74 and covered by the inlet cryopanel 32. Therefore, it is possible to reduce the thermal load of the second stage cryopanel assembly 20.

The inlet cryopanel 32 is relatively small, and the opening region 51 of the intake port 12 can be relatively large. Therefore, the inlet cryopanel 32 does not significantly impede an entry of non-condensable gas into the internal space 14 of the cryopump 10. Thus, the cryopump 10 can exhaust non-condensable gas with a high pumping speed.

In addition, the inlet cryopanel 32 is disposed close to the top cryopanel 60*a* so as to completely block the direct incidences of the gas molecules onto top cryopanel 60*a*. Therefore, it is possible to significantly reduce the thermal load of the second stage cryopanel assembly 20.

The upper surface of the top cryopanel 60*a* is covered with the central flat plate 76 of the inlet cryopanel 32, and the entire periphery of the top cryopanel 60*a* is surrounded by the downward inclined section 78 of the inlet cryopanel 32. The inlet cryopanel 32, that is, the top cryopanel accommodation compartment 74 is a truncated cone shape. In this way, it is possible to completely suppress the thermal load from the side as well as the heat incidence to the top cryopanel 60*a* from above. In addition, a flow rate of the non-condensable gas in the opening region 51 of the intake port 12 can increase. For example, compared to a case where the inlet cryopanel 32 is cylindrical, the flow rate of non-condensable gas increases.

The ring-shaped inlet 84 to the top cryopanel accommodation compartment 74 is formed between the downward inclined section 78 of the inlet cryopanel 32 and the upward inclined section 82 of the adjacent cryopanel 60*c*. The ring-shaped inlet 84 can receive the non-condensable gas from the entire periphery to the top cryopanel accommodation compartment 74 in the circumferential direction. The non-condensable gas which has entered the top cryopanel accommodation compartment 74 through the ring-shaped inlet 84 can be captured by the adsorption region 64 of the top cryopanel 60*a*.

Only the top cryopanel 60*a* is accommodated in the top cryopanel accommodation compartment 74. According to studies of the inventors, in this case, a thermal load reduction of the second stage cryopanel assembly 20 and an improvement of the pumping speed of the non-condensable gas can be realized in a most balanced manner.

The top cryopanel 60*a* is a flat plate, and thus, the axial height is small. Therefore, the axial height of the inlet cryopanel 32 can also be reduced.

Hereinbefore, embodiments of the present invention are described. It should be understood that the invention is not limited to the above-described embodiment, but may be modified into various forms on the basis of the spirit of the invention. Additionally, the modifications are included in the scope of the invention.

In the above-described embodiment, the top cryopanel accommodation cryopanel is disposed close to the top cryopanel so as to completely block the direct incidences of the gas molecules from the outside of the cryopump onto top cryopanel. However, the top cryopanel accommodation cryopanel is disposed close to the top cryopanel so as to partially block the direct incidences of the gas molecules from the outside of the cryopump onto top cryopanel.

The shape of the top cryopanel accommodation cryopanel is not limited to the conical shape and may be a cylindrical shape, for example. The top cryopanel accommodation cryopanel may include a central flat plate which faces the upper surface of the top cryopanel and an outer peripheral section which extends from an outer periphery of the central flat plate perpendicularly axially downward with respect to the central flat plate and surrounds the entire outer periphery of the top cryopanel. The top cryopanel accommodation compartment may be a cylindrical space defined by the central flat plate and the outer peripheral section.

The shape of the adjacent cryopanel is not limited to the inverted truncated cone shape and may be a cylindrical shape, for example. The adjacent cryopanel may comprise a cryopanel center section which faces the lower surface of the top cryopanel, and an outer peripheral section which extends from an outer periphery of the cryopanel center section perpendicularly axially upward with respect to the cryopanel center section. The outer peripheral section of adjacent cryopanel may extend circumferentially along the outer peripheral section of the top cryopanel accommodation cryopanel. A ring-shaped inlet to the top cryopanel accommodation compartment may be formed between the outer peripheral section of the adjacent cryopanel and the outer peripheral section of the top cryopanel accommodation cryopanel.

The top cryopanel accommodation cryopanel may accommodate a plurality of cryopanels. For example, the top cryopanel accommodation cryopanel may accommodate the top cryopanel and the cryopanel disposed immediately below the top cryopanel in the axial direction.

The top cryopanel may have a shape different from a flat plate. The top cryopanel may have a shape different from a disk.

The present invention can be used in a field of a cryopump.

What is claimed is:

1. A cryopump comprising:

a cryocooler that comprises:

a high-temperature cooling stage configured to be cooled to a first cooling temperature, and a low-temperature cooling stage configured to be cooled to a second cooling temperature lower than the first cooling temperature;

a radiation shield that:

is thermally coupled to the high-temperature cooling stage, and axially extends in a tubular shape from a cryopump intake port;

a low-temperature cryopanel section that is:

thermally coupled to the low-temperature cooling stage, and surrounded by the radiation shield; and a top cryopanel accommodation cryopanel that is:

directly mounted to the high-temperature cooling stage, thermally coupled to the high-temperature cooling stage, and disposed in the cryopump intake port to form a top cryopanel accommodation compartment, wherein the low-temperature cryopanel section comprises axially arranged cryopanels, wherein a top cryopanel of the axially arranged cryopanels is:

directly mounted to the low-temperature cooling stage, and disposed closest to the cryopump intake port, wherein the top cryopanel accommodation cryopanel comprises:

a central flat plate facing an upper surface of the top cryopanel, and an outer peripheral section extending from the central flat plate downward beyond the top cryopanel and arranged radially outward with respect to the top cryopanel to surround the top cryopanel.

2. The cryopump according to claim 1, wherein the top cryopanel accommodation cryopanel is disposed close to the top cryopanel so as to at least partially block a direct incidence of a gas molecule from an outside of the cryopump onto the top cryopanel.

3. The cryopump according to claim 1, wherein the top cryopanel accommodation cryopanel is disposed close to the top cryopanel so as to completely block a direct incidence of a gas molecule from an outside of the cryopump onto the top cryopanel.

4. The cryopump according to claim 1, wherein the outer peripheral section of the top cryopanel accommodation cryopanel includes a downward inclined section which extends from an outer periphery of the central flat plate to be inclined axially downward and radially outward with respect to the central flat plate and surrounds an entire outer periphery of the top cryopanel, and wherein the top cryopanel accommodation compartment is a truncated cone-shaped space which is defined by the central flat plate and the downward inclined section.

5. The cryopump according to claim 1, wherein:

the axially arranged cryopanels of the low-temperature cryopanel section comprise an adjacent cryopanel which is disposed to be adjacent to the top cryopanel axially below the top cryopanel, the adjacent cryopanel comprises a cryopanel center section which faces a lower surface of the top cryopanel and an upward inclined section which extends from an outer periphery of the cryopanel center section to be inclined axially upward and radially outward with respect to the cryopanel center section, the upward inclined section of the adjacent cryopanel circumferentially extends along a downward inclined section of the top cryopanel accommodation cryopanel, and a ring-shaped inlet to the top cryopanel accommodation compartment is formed between the upward inclined section and the downward inclined section.

6. The cryopump according to claim 5, wherein the ring-shaped inlet is only a gas passage leading to the top cryopanel accommodation compartment.

7. The cryopump according to claim 1, wherein only the top cryopanel among the axially arranged cryopanels of the low-temperature cryopanel section is accommodated in the top cryopanel accommodation compartment.

8. The cryopump according to claim 7, wherein the other cryopanels of the axially arranged cryopanels are not accommodated in the top cryopanel accommodation compartment.

9. The cryopump according to claim 1, wherein the top cryopanel is accommodated in the top cryopanel accommodation compartment.

10. The cryopump according to claim 1, wherein the top cryopanel is a flat plate.

11. The cryopump according to claim 1, wherein the top cryopanel accommodation cryopanel is truncated cone-shaped or cylindrical.

12. The cryopump according to claim 1, wherein the axially arranged cryopanels of the low-temperature cryopanel section include a lower cryopanel which is disposed axially below the top cryopanel, the lower cryopanel forms a ring-shaped inlet to the top cryopanel accommodation compartment together with the top cryopanel accommodation cryopanel, wherein the lower cryopanel is inverted truncated cone-shaped or cylindrical.

13. The cryopump according to claim 1, wherein the top cryopanel accommodation cryopanel and the top cryopanel are cooled by the high-temperature cooling stage and the low-temperature cooling stage, respectively, wherein the top cryopanel accommodation cryopanel is cooled to a temperature higher than that of the top cryopanel.

14. The cryopump according to claim 1, wherein the top cryopanel accommodation cryopanel is attached to the radiation shield.

15. The cryopump according to claim 1, wherein the low-temperature cryopanel section comprises a panel attachment member axially extending from the low-temperature cooling stage, and wherein the top cryopanel is attached to the panel attachment member.

16. A cryopump comprising:

a cryocooler that comprises:

a high-temperature cooling stage configured to be cooled to a first cooling temperature, and a low-temperature cooling stage configured to be cooled to a second cooling temperature lower than the first cooling temperature;

a radiation shield that is:

thermally coupled to the high-temperature cooling stage, and axially extends in a tubular shape from a cryopump intake port;

a low-temperature cryopanel section that is:

thermally coupled to the low-temperature cooling stage, and surrounded by the radiation shield; and a top cryopanel accommodation cryopanel that is:

attached to the radiation shield, thermally coupled to the high-temperature cooling stage, and disposed in the cryopump intake port to form a top cryopanel accommodation compartment, wherein the low-temperature cryopanel section comprises:

a panel attachment member axially extending from the low-temperature cooling stage, and axially arranged cryopanels attached to the panel attachment member, wherein a top cryopanel of the axially arranged cryopanels is closest to the cryopump intake port, wherein the top cryopanel accommodation cryopanel comprises:

a central flat plate facing an upper surface of the top cryopanel, and an outer peripheral section extending from the central flat plate downward beyond the top cryopanel and arranged radially outward with respect to the top cryopanel to surround the top cryopanel.

17. The cryopump according to claim 16, wherein:

the axially arranged cryopanels of the low-temperature cryopanel section comprise an adjacent cryopanel which is disposed to be adjacent to the top cryopanel axially below the top cryopanel, the adjacent cryopanel comprises a cryopanel center section which faces a lower surface of the top cryopanel and an upward inclined section which extends from an outer periphery of the cryopanel center section to be inclined axially upward and radially outward with respect to the cryopanel center section, the upward inclined section of the adjacent cryopanel circumferentially extends along a downward inclined section of the top cryopanel accommodation cryopanel, and a ring-shaped inlet to the top cryopanel accommodation compartment is formed between the upward inclined section and the downward inclined section.

18. The cryopump according to claim 17, wherein the ring-shaped inlet is only a gas passage leading to the top cryopanel accommodation compartment.

* * * * *